US009278277B2

(12) United States Patent
Hardman et al.

(10) Patent No.: US 9,278,277 B2
(45) Date of Patent: Mar. 8, 2016

(54) ULTRASONIC APPARATUS TO ENHANCE OIL EXTRACTION FROM A BOWLING BALL

(71) Applicants: John Arthur Hardman, Lawrence, KS (US); Alex Arthur Hardman, Lawrence, KS (US); Russ Scott Wilson, Lawrence, KS (US)

(72) Inventors: John Arthur Hardman, Lawrence, KS (US); Alex Arthur Hardman, Lawrence, KS (US); Russ Scott Wilson, Lawrence, KS (US)

( * ) Notice: Subject to any disclaimer, the term of this patent is extended or adjusted under 35 U.S.C. 154(b) by 0 days.

(21) Appl. No.: 14/331,511

(22) Filed: Jul. 15, 2014

(65) Prior Publication Data

US 2015/0013731 A1 Jan. 15, 2015

Related U.S. Application Data

(60) Provisional application No. 61/846,370, filed on Jul. 15, 2013.

(51) Int. Cl.
*A63D 5/10* (2006.01)

(52) U.S. Cl.
CPC ..... *A63D 5/10* (2013.01)

(58) Field of Classification Search
CPC ..... A63D 5/10
See application file for complete search history.

(56) References Cited

U.S. PATENT DOCUMENTS

| | | | | |
|---|---|---|---|---|
| 2,845,077 | A | 7/1958 | Branson | |
| 3,101,089 | A * | 8/1963 | Brown | A63B 57/0087 134/1 |
| 5,141,009 | A * | 8/1992 | Morantz | A63B 57/0087 134/1 |
| 2011/0232122 | A1 * | 9/2011 | Butler | F26B 9/003 34/282 |
| 2013/0319474 | A1 | 12/2013 | Payne | |
| 2013/0340792 | A1 | 12/2013 | Ott | |

* cited by examiner

*Primary Examiner* — Jason Ko
(74) *Attorney, Agent, or Firm* — Plager Schack LLP

(57) ABSTRACT

An apparatus to enhance oil extraction from pores of a bowling ball includes a housing unit with an opening, a tank disposed within the opening and able to store a fluid, a rack disposed within the tank to secure the bowling ball in a stationary position and orient the ball such that at least one finger hole of the ball is positioned above an upper level of the stored fluid, a heating unit coupled to the tank to heat the stored fluid, and at least one ultrasonic transducer coupled to the tank. The at least one transducer directs sound waves through the heated fluid toward the secured bowling ball, thereby extracting oil from the bowling ball.

10 Claims, 4 Drawing Sheets

FIG.1
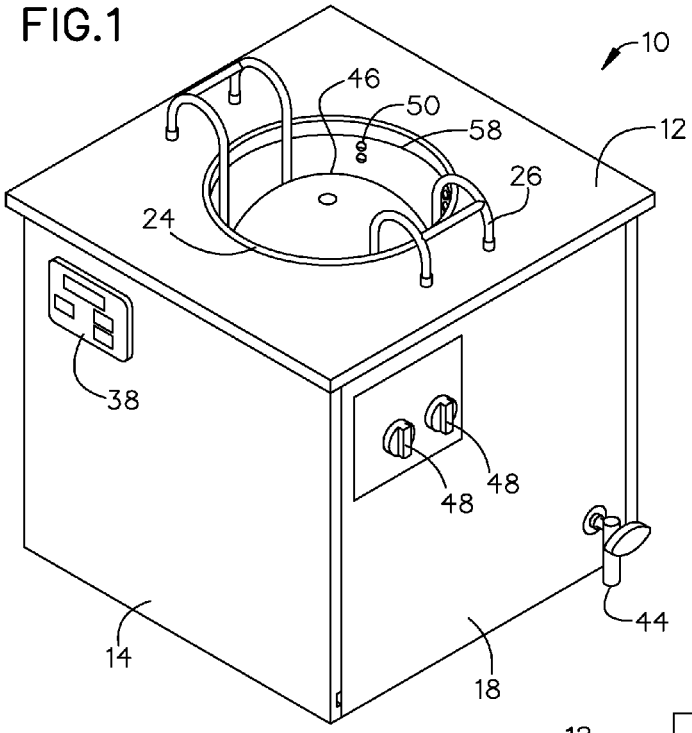
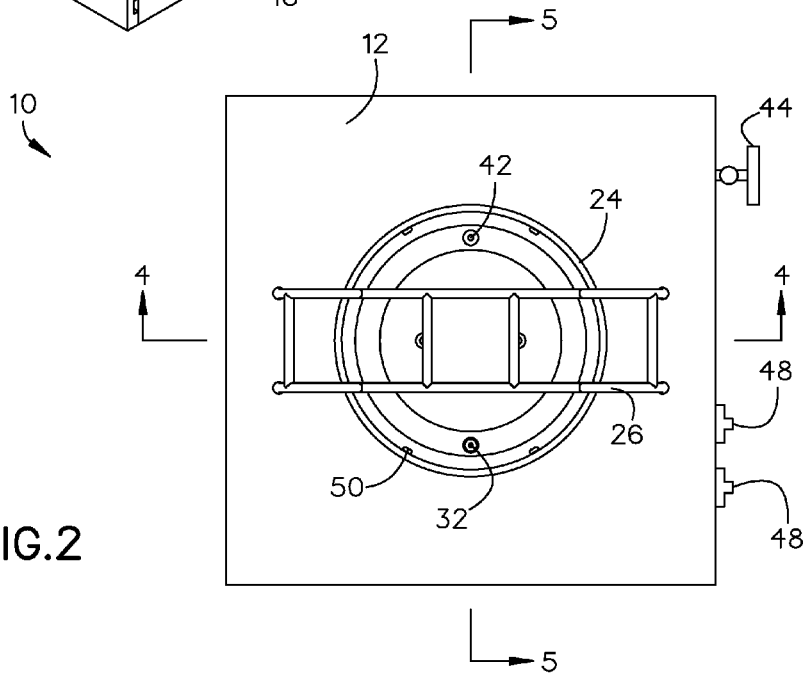
FIG.2

ULTRASONIC APPARATUS TO ENHANCE OIL EXTRACTION FROM A BOWLING BALL

RELATED APPLICATION

The application claims priority to provisional patent application U.S. Ser. No. 61/846,370 filed on Jul. 15, 2013, the entire contents of which is herein incorporated by reference.

BACKGROUND

The embodiments herein relate generally to devices for extracting oil from bowling balls.

Bowling alleys regularly use oil to protect and condition the surfaces of lanes. Over time, bowling balls collect and absorb significant amounts of oil and/or dirt. This affects the speed and rotation of the ball as it travels down the lane, which can negatively affect the bowler's performance and overall score during a game.

Several bowling ball maintenance and cleaning devices exist such as U.S. Patent Application Publications 2013/0340792 and 2013/0319474. However, these devices rely on the circulation of heated air or steam to clean or remove oil from a bowling ball. These devices are limited in removing oil from the ball because the circulated air and steam do not reliably penetrate the surface of the bowling ball. Therefore, the cleaning effectiveness of these devices is diminished. U.S. Pat. No. 2,845,077 discloses an apparatus for cleaning articles by using a cleaning liquid and transducing element. However, this apparatus is limited because it is not designed to secure a bowling ball. Further, the apparatus is disadvantageous because the transducing elements are not oriented to maximize oil extraction from a bowling ball.

As such, there is a need in the industry for an apparatus that enhances oil extraction from a bowling ball, which addresses the limitations of the prior art described above.

SUMMARY

An apparatus configured to enhance oil extraction from pores of a bowling ball to improve user performance of the bowling ball when in use is provided. The apparatus comprises a housing unit comprising an opening on a top portion of the unit, a tank disposed within the opening and mechanically coupled to the housing unit, wherein the tank is configured to store a fluid, a rack disposed within the tank and configured to secure the bowling ball in a stationary position and orient the ball such that at least one finger hole of the ball is positioned above an upper level of the stored fluid and exposed to a surrounding environment, a heating unit coupled to the tank and configured to heat the stored fluid, and at least one ultrasonic transducer coupled to the tank, wherein the at least one transducer is configured to direct sound waves through the heated fluid toward the secured bowling ball, thereby extracting oil from the bowling ball.

BRIEF DESCRIPTION OF THE FIGURES

The detailed description of some embodiments of the invention will be made below with reference to the accompanying figures, wherein the figures disclose one or more embodiments of the present invention.

FIG. 1 depicts a perspective view of certain embodiments of the bowling ball oil extraction apparatus shown in use;

FIG. 2 depicts a top view of certain embodiments of the bowling ball oil extraction apparatus;

DETAILED DESCRIPTION OF CERTAIN EMBODIMENTS

Figure 3:
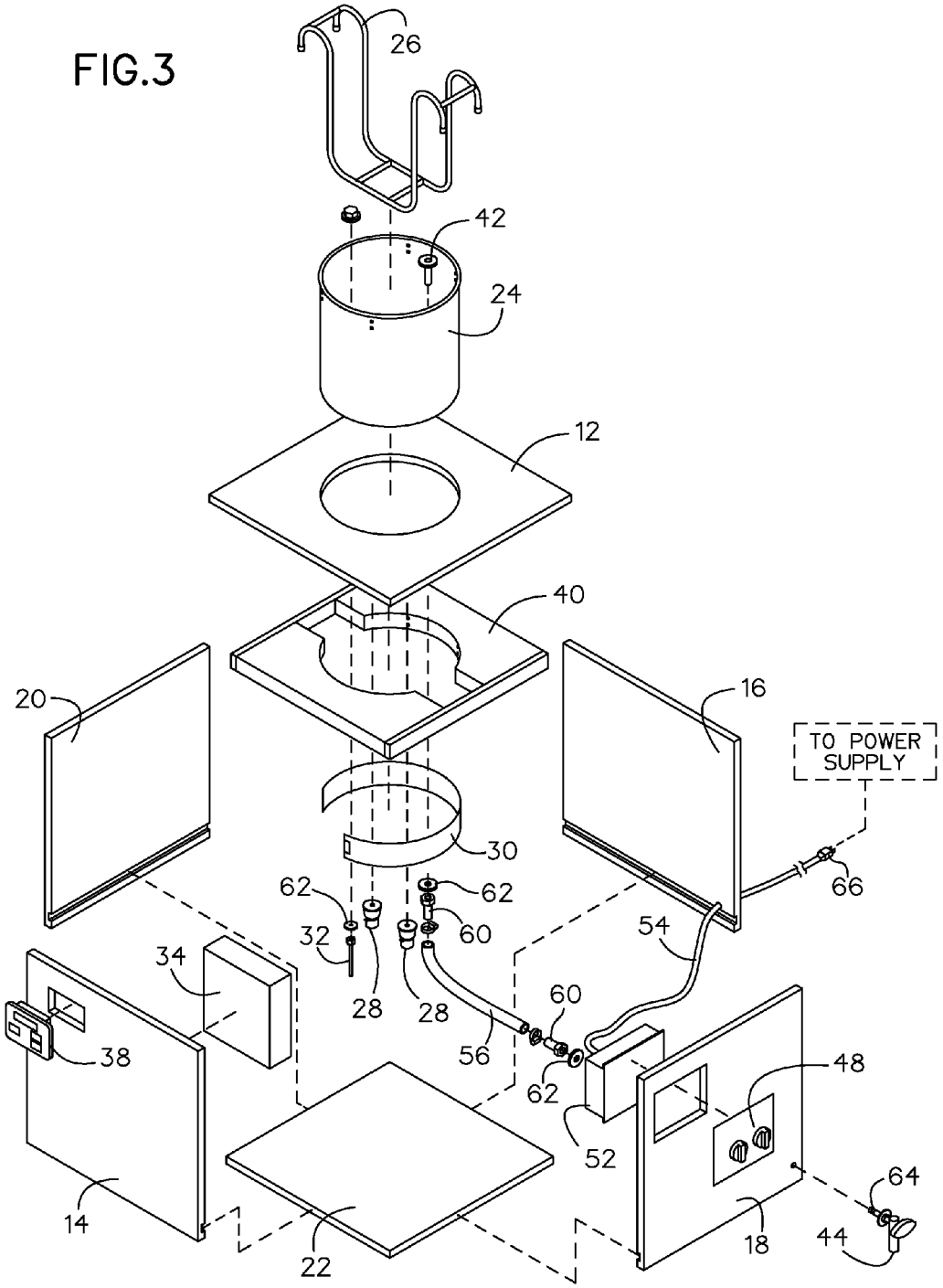
FIG. 3 depicts an exploded view of certain embodiments of the bowling ball oil extraction apparatus.

As depicted in FIGS. 1-3, apparatus 10 is configured to extract oil and/or dirt from bowling ball 46. Bowling ball 46 may be any type known in the field. Apparatus 10 comprises a housing comprising top cabinet portion 12, front cabinet portion 14, back cabinet portion 16, right cabinet portion 18, left cabinet portion 20 and bottom cabinet portion 22, which creates a cavity within the housing. Cabinet portions 12, 14, 16, 18, 20 and 22 are made from a particle board wood product. The particle board may be laminated to enhance durability and provide water resistance to the surfaces.

Figure 4:
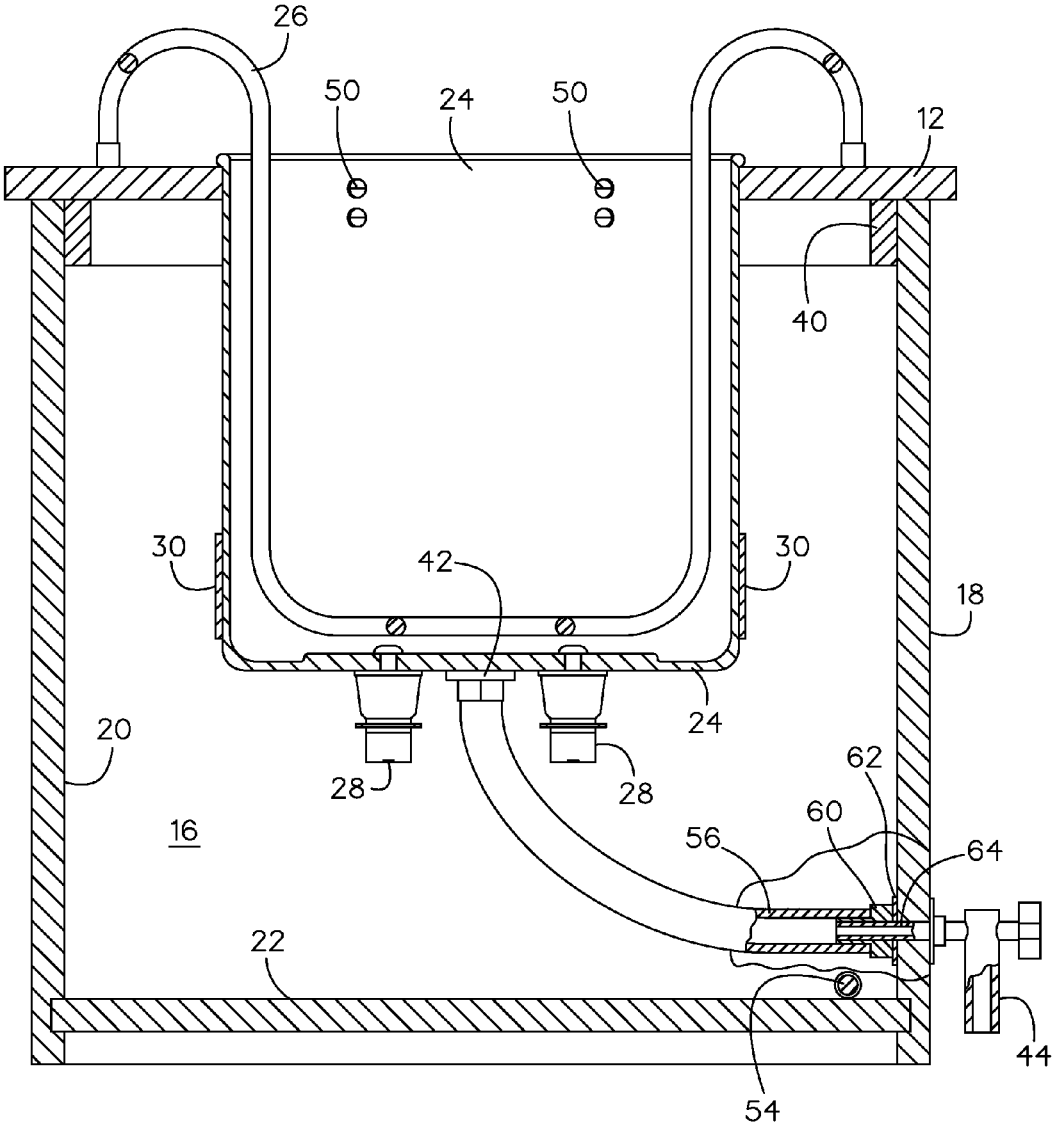
FIG. 4 depicts a section view of certain embodiments of the bowling ball oil extraction apparatus taken along line 4-4 in FIG. 2.

Top cabinet portion 12 comprises a circular opening to receive tank 24. Top support 40 is secured below top cabinet portion 12, and also comprises an opening. Tank 24 is a cylindrical tank made from stainless steel and is configured to store any type of fluid mixture including, but not limited to water and/or a detergent. Any amount of fluid is disposed in tank 24 up to a fluid line 58. Tank 24 is disposed within the openings of top cabinet portion 12 and top support 40. Tank 24 is fastened to top cabinet portion 12 and/or top support 40 by stainless steel screws 50 as depicted in FIG. 4. Stainless steel screws 50 are placed throughout the walls of tank 24. While the figures depict eight stainless steel screws 50 used, it shall be appreciated that any alternative number of screws may be used instead.

Rack 26 is made from stainless steel and comprises two U-shaped rods oriented parallel to one another. A pair of connecting rods is affixed perpendicularly to the bottom portions of the U-shaped rods. The connecting rods are configured to contact the bottom portion of bowling ball 46 when disposed within tank 24. Each U-shaped rod of rack 26 further comprises a curvature at each end, which creates end portions that contact the surface of top cabinet 12 when rack 26 is disposed within tank 24.

Thermocouple 32 is affixed to a bottom portion of tank 24 and is configured to measure the temperature of the fluid disposed within the tank. Silicon heater 30 is affixed around tank 24 and is configured to heat the fluid stored therein. It shall be appreciated that alternative types of heaters may be used instead. Temperature control unit 38 is affixed to front cabinet portion 14 and is connected to silicon heater 30 and thermocouple 32 via wires (not shown). Temperature control unit 38 comprises any electrical components known in the field to enable a user to control, monitor and adjust, the temperature of the fluid stored within tank 24. Temperature control unit 38 may include input buttons and a screen to display information such as the current fluid temperature, desired fluid temperature, or the like.

In one embodiment, fluid outlet 44 is affixed to right cabinet portion 18. Fluid outlet 44 is connected to drain 42 of tank 24 by drain tube 56. As depicted in FIGS. 3-4, components such as drain fittings 60, drain valve fitting 64 and washers 62 are used to secure drain tube 56 to fluid outlet 44 and drain 42. This configuration allows a user to easily evacuate the fluid stored within tank 24 via drain tube 56 and fluid outlet 44 when necessary.

Ultrasonic transducers 28 are bolted to the bottom of tank 24 and a silicone layer may be applied thereon. In a preferred embodiment, ultrasonic transducers 28 are most effective in implementing the functionality of apparatus 10 when rated at 40 kHz. However, alternative types of transducers may be used instead. While the figures depict two ultrasonic transducers 28, it shall be appreciated that any number of transducers may be used. Ultrasonic generator 34 is affixed to front cabinet portion 14 and is configured to supply power to transducers 28 by wires (not shown).

Electrical box 52 is affixed to the inner wall of right cabinet portion 18 and is connected to a power supply such as an outlet via electrical cord 54 and ground-fault circuit interrupter ("GFCI") plug 66. Electrical box 52 supplies power to temperature control unit 38, silicon heater 30, ultrasonic generator 34 and ultrasonic transducers 28 via wires (not shown). Alternatively, one or more of these components may use a separate power source such as a battery.

In one embodiment, timer switches 48 are affixed to right cabinet portion 18. The switches allow electrical box 52 to supply power to silicon heater 30 and ultrasonic transducers 28 for any time period up to a maximum specified time period. A first timer switch 48 is connected to silicon heater 30 and a second timer switch 48 is connected to ultrasonic transducers 28. Once the set time expires, power is automatically cut off to the respective component. In a preferred embodiment, first timer switch 48 has a maximum operating time of four hours and second timer switch 48 has a maximum operating time of one hour.

Figure 5:
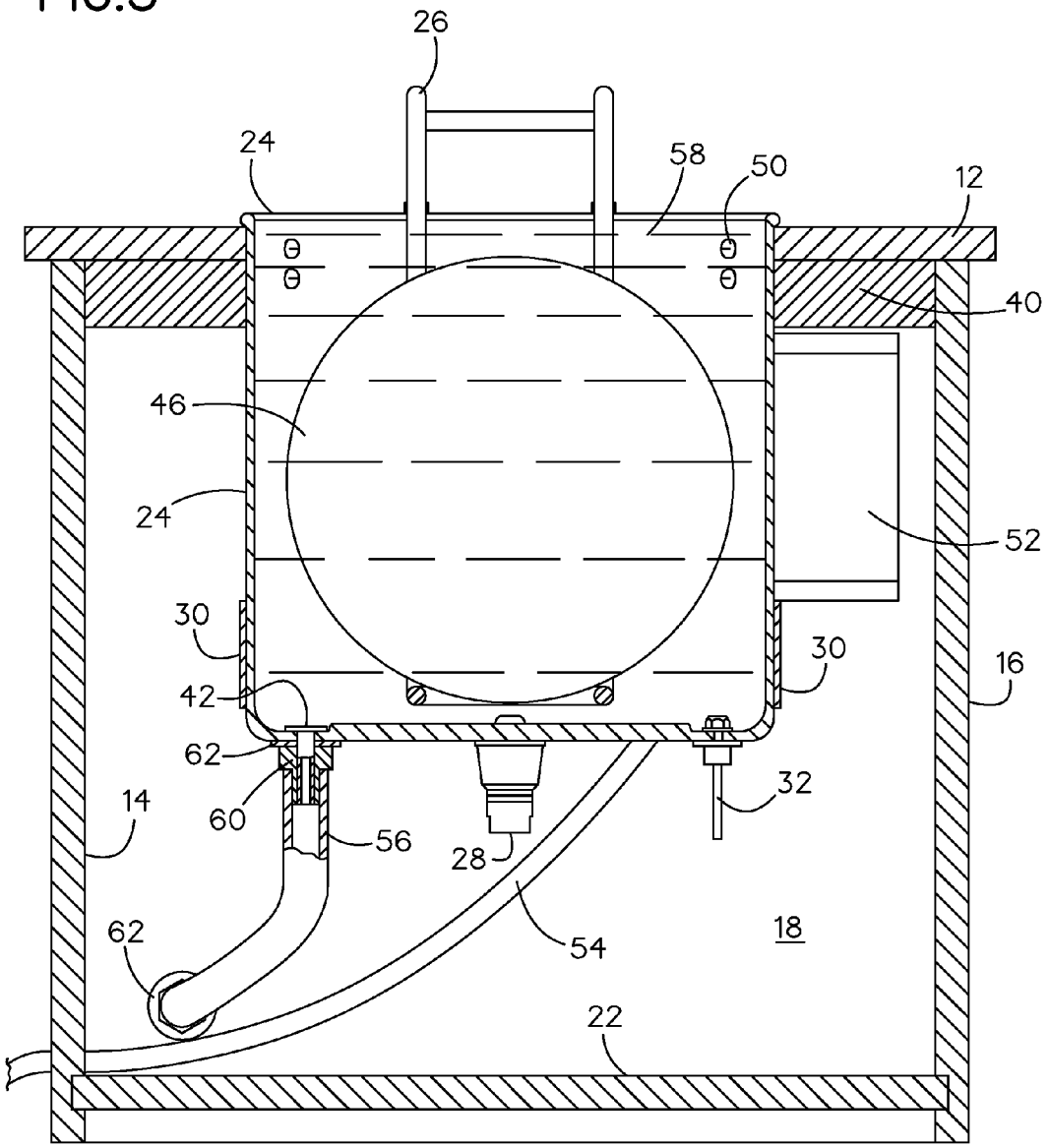
FIG. 5 depicts a section view of certain embodiments of the bowling ball oil extraction apparatus taken along line 5-5 in FIG. 2.

In operation, apparatus 10 is connected to a power supply via GFCI plug 66. As depicted in FIG. 5, water is disposed within tank 24 up to fluid level 58. While any amount of water may be used, fluid level 58 is preferably below the top portion of bowling ball 46 when placed in tank 24 and secured in a stationary position by rack 26. This allows one or more holes of the ball, such as the thumb hole, to be positioned above fluid level 58 and exposed to a surrounding environment. This keeps the interior of the hole dry to allow a user to dispose tape within to enhance game performance, if desired by a user.

The first timer switch 48 is adjusted to power up silicon heater 30 to heat the stored water to a desired temperature. A user sets the desired temperature via temperature control unit 38, which is approximately 115 degrees Fahrenheit in a preferred embodiment. Thermocouple 32 communicates with temperature control unit 38 and controls the On/Off operation of silicon heater 30 to maintain the stored water at the desired temperature. The second time switch 48 is adjusted to allow ultrasonic generator 34 to supply power to ultrasonic transducers 28. This enables ultrasonic transducers 28 to generate sound waves that transmit through the stored water in tank 24. The generated sound waves penetrate bowling ball 46. The combination of the heated fluid in tank 24 and the ultrasonic waves generated cause a cavitation, which enhances oil and dirt extraction through pores of bowling ball 46. In a preferred embodiment, ultrasonic transducers 28 operate for 15-30 minutes. However, alternative time periods may be as effective. Once complete, bowling ball 46 is removed from apparatus 10. Oil and dirt remain in the stored water, which can be evacuated and disposed via fluid outlet 44. It shall be appreciated that a detergent configured to accelerate the oil and dirt extraction process may be added to the water in tank 24.

It shall be appreciated that the components of apparatus 10 described in several embodiments herein may comprise any alternative known materials in the field and be of any color, size and/or dimensions. It shall be appreciated that the components of apparatus 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An apparatus configured to enhance oil extraction from pores of a bowling ball to improve user performance of the bowling ball when in use, the apparatus comprising:

a housing unit comprising an opening on a top portion of the unit;

a tank disposed within the opening and mechanically coupled to the housing unit, wherein the tank is configured to store a fluid;

a rack disposed within the tank and comprising a pair of generally U-shaped rods coupled together by a connecting rod, the rack configured to secure the bowling ball within space defined between the U-shaped rods and the connecting rod to permit the ball to remain suspended in a stationary position with at least one finger hole of the ball positioned above an upper level of the stored fluid and exposed to a surrounding environment;

a heating unit coupled to the tank and configured to heat the stored fluid; and at least one ultrasonic transducer coupled to the tank, wherein the at least one transducer is configured to direct sound waves through the heated fluid toward the secured bowling ball, thereby extracting oil from the bowling ball.

2. The apparatus of claim 1, wherein a bottom portion of the rack is positioned a sufficient distance away from the at least one transducer to prevent the secured bowling ball from baffling the sound waves directed by the transducer.

3. The apparatus of claim 2, further comprising a temperature control unit affixed to the housing unit and operably connected to the heating unit.

4. The apparatus of claim 3, further comprising a thermocouple affixed to the tank and operably connected to the temperature control unit.

5. The apparatus of claim 4, wherein the heating unit is a silicon heater.

6. The apparatus of claim 4, further comprising an electrical box affixed to the housing unit and operably connected to the silicon heater.

7. The apparatus of claim 6, further comprising a GFCI plug affixed to the electrical box, wherein the GFCI plug is configured to be connected to a power supply.

8. The apparatus of claim 6, further comprising an ultrasonic generator affixed to the housing unit and operably connected to the at least one ultrasonic transducer.

9. The apparatus of claim 6, further comprising an outlet affixed to the housing unit and comprising a conduit affixed to the tank, wherein the outlet is configured to evacuate the stored fluid out of the tank.

10. The apparatus of claim 6, further comprising a first timer switch and a second timer switch both affixed to the housing unit, wherein the first timer switch is operably connected to the temperature control unit and the second timer switch is operably connected to the ultrasonic generator.

* * * * *